US009073357B1

(12) United States Patent
Condello et al.

(10) Patent No.: US 9,073,357 B1
(45) Date of Patent: Jul. 7, 2015

(54) INDIRECT INKJET PRINTER AND BLOWER FOR TREATMENT OF A HYDROPHILIC LAYER ON AN IMAGE RECEIVING SURFACE IN THE INDIRECT INKJET PRINTER

(71) Applicant: Xerox Corporation, Norwalk, CT (US)

(72) Inventors: Anthony S. Condello, Victor, NY (US); Christopher G. Lynn, Wolcott, NY (US); Chu-Heng Liu, Penfield, NY (US); Daniel J. McVeigh, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/219,518

(22) Filed: Mar. 19, 2014

(51) Int. Cl.
*B41J 11/00* (2006.01)

(52) U.S. Cl.
CPC ..... *B41J 11/0015* (2013.01)

(58) Field of Classification Search
USPC ..... 347/101
See application file for complete search history.

(56) References Cited

U.S. PATENT DOCUMENTS

| | | | | |
|---|---|---|---|---|
| 4,035,214 | A | 7/1977 | Shuppert et al. | |
| 4,135,960 | A | 1/1979 | Shuppert et al. | |
| 4,673,303 | A | 6/1987 | Sansone et al. | |
| 5,623,296 | A | 4/1997 | Fujino et al. | |
| 5,750,314 | A | 5/1998 | Fromson et al. | |
| 6,059,407 | A | 5/2000 | Komatsu et al. | |
| 6,335,978 | B1 | 1/2002 | Moscato et al. | |
| 6,357,870 | B1 | 3/2002 | Beach et al. | |
| 6,709,096 | B1 | 3/2004 | Beach et al. | |
| 6,713,160 | B2 | 3/2004 | Kitamura et al. | |
| 7,281,790 | B2 | 10/2007 | Mouri et al. | |
| 7,686,445 | B2 | 3/2010 | Fioravanti et al. | |
| 7,869,099 | B2 * | 1/2011 | Mashtare | 358/406 |
| 8,011,781 | B2 | 9/2011 | Taniuchi et al. | |
| 8,025,389 | B2 | 9/2011 | Yamanobe et al. | |
| 8,132,885 | B2 * | 3/2012 | Ramakrishnan et al. | 347/19 |
| 8,511,815 | B2 * | 8/2013 | Yamanobe | 347/101 |
| 2002/0196321 | A1 | 12/2002 | Katsuki | |
| 2007/0285486 | A1 | 12/2007 | Harris et al. | |
| 2008/0032072 | A1 * | 2/2008 | Taniuchi et al. | 428/32.11 |
| 2011/0234692 | A1 | 9/2011 | Haijima et al. | |
| 2011/0234729 | A1 | 9/2011 | Noguchi | |
| 2012/0013694 | A1 | 1/2012 | Kanke | |
| 2013/0127965 | A1 | 5/2013 | Kushida et al. | |
| 2013/0127966 | A1 | 5/2013 | Noguchi et al. | |
| 2013/0222502 | A1 | 8/2013 | Kobayashi | |

FOREIGN PATENT DOCUMENTS

| | | | |
|---|---|---|---|
| EP | 0 583 168 | B1 | 10/1998 |
| EP | 1 919 711 | B1 | 11/2010 |
| JP | 2767796 | B2 | 6/1998 |
| JP | 3169634 | A | 5/2001 |
| JP | 2001-212956 | A | 8/2001 |
| JP | 4006374 | B2 | 11/2001 |

(Continued)

*Primary Examiner* — Stephen Meier
*Assistant Examiner* — Alexander D Shenderov
(74) *Attorney, Agent, or Firm* — Maginot Moore & Beck LLP

(57) ABSTRACT

An inkjet printer includes a blower that directs heated air flow towards a layer of a hydrophilic composition on an image receiving surface. A controller regulates the operation of the blower with reference to image data of ink drops on an image receiving member to control a dryness level of the hydrophilic composition layer.

19 Claims, 5 Drawing Sheets

(56) References Cited

FOREIGN PATENT DOCUMENTS

| | | | |
|---|---|---|---|
| JP | 2002-138228 | A | 5/2002 |
| JP | 3379558 | B2 | 2/2003 |
| WO | 93/17000 | A1 | 4/1993 |
| WO | 2011-014185 | A1 | 2/2011 |

* cited by examiner

INDIRECT INKJET PRINTER AND BLOWER FOR TREATMENT OF A HYDROPHILIC LAYER ON AN IMAGE RECEIVING SURFACE IN THE INDIRECT INKJET PRINTER

TECHNICAL FIELD

This disclosure relates generally to aqueous indirect inkjet printers, and, in particular, to surface preparation for aqueous ink inkjet printing.

BACKGROUND

In general, inkjet printing machines or printers include at least one printhead that ejects drops or jets of liquid ink onto a recording or image forming surface. An aqueous inkjet printer employs water-based or solvent-based inks in which pigments or other colorants are suspended or in solution. Once the aqueous ink is ejected onto an image receiving surface by a printhead, the water or solvent is evaporated to stabilize the ink image on the image receiving surface. When aqueous ink is ejected directly onto media, the aqueous ink tends to soak into the media when it is porous, such as paper, and change the physical properties of the media. Because the spread of the ink droplets striking the media is a function of the media surface properties and porosity, the print quality is inconsistent. To address this issue, indirect printers have been developed that eject ink onto a blanket mounted to a drum or endless belt. The ink is dried on the blanket and then transferred to media. Such a printer avoids the changes in image quality, drop spread, and media properties that occur in response to media contact with the water or solvents in aqueous ink. Indirect printers also reduce the effect of variations in other media properties that arise from the use of widely disparate types of paper and films used to hold the final ink images.

In aqueous ink indirect printing, an aqueous ink is jetted onto an intermediate imaging surface, typically called a blanket, and the ink is partially dried on the blanket prior to transfixing the image to a media substrate, such as a sheet of paper. To ensure excellent print quality the ink drops jetted onto the blanket must spread well and not poorly coalesce prior to drying. Otherwise, the ink images appear grainy and have deletions. The lack of spreading can also cause missing or failed inkjets in the printheads to produce streaks in the ink image. Spreading of aqueous ink is facilitated by materials having a high energy surface. In order to facilitate transfer of the ink image from the blanket to the media substrate, however, a blanket having a surface with a relatively low surface energy is preferred. These diametrically opposed and competing properties for a blanket surface make selections of materials for blankets difficult. Reducing ink drop surface tension helps, but the spread is still generally inadequate for appropriate image quality. Offline oxygen plasma treatments of blanket materials that increase the surface energy of the blanket have been tried and shown to be effective. The benefit of such offline treatment may be short lived due to surface contamination, wear, and aging over time.

One challenge confronting indirect aqueous inkjet printing processes relates to the spread of ink drops during the printing process. Indirect image receiving members are formed from low surface energy materials that promote the transfer of ink from the surface of the indirect image receiving member to the print medium that receives the final printed image. Low surface energy materials, however, also tend to promote the "beading" of individual ink drops on the image receiving surface. Since a printer partially dries the aqueous ink drops prior to transferring the ink drops to the print medium, the aqueous ink does not have an opportunity to be forced to be spread during the transferring/printing process. The resulting printed image may appear to be grainy and solid lines or solid printed regions are reproduced as a series of dots instead of continuous features in the final printed image. Consequently, improvements to indirect inkjet printers that improve the spreading characteristics of aqueous ink drops during an indirect printing process would be beneficial.

SUMMARY

In one embodiment, a controller in an indirect inkjet printer regulates the operation of a blower to control ink spreading on an image receiving surface. The printer includes an indirect image receiving member having an image receiving surface configured to move in a process direction in the inkjet printer, a surface maintenance unit configured to apply a layer of a hydrophilic composition comprising a liquid carrier and an absorption agent to the image receiving surface, a blower configured to direct a flow of air toward the hydrophilic composition on the image receiving surface to remove at least a portion of the liquid carrier from the layer of hydrophilic composition, a plurality of inkjets configured to eject aqueous ink onto the dried layer to form an aqueous ink image on the image receiving surface, a transfix member that engages the image receiving member to form a transfix nip, the transfix member being configured to apply pressure to a print medium moving through the transfix nip as the aqueous ink image on the dried layer moves through the transfix nip to transfix the aqueous ink image and the region of the dried layer that receives the aqueous ink to a surface of the print medium, an optical sensor configured to generate image data of ink drops on the image receiving member, and a controller operatively connected to the blower and the optical sensor, the controller being configured to operate the blower with reference to the image data of the ink drops on the image receiving member.

In another embodiment, a hydrophilic composition treatment system is configured for use in an indirect inkjet printer to control ink spreading on an image receiving surface in the printer. The hydrophilic composition system includes a blower configured to direct a flow of air toward a hydrophilic composition on an image receiving surface in the inkjet printer to remove at least a portion of liquid carrier in the hydrophilic composition, an optical sensor configured to generate image data of ink drops on the image receiving member, and a controller operatively connected to the blower and the optical sensor, the controller being configured to operate the blower with reference to the image data of the ink drops on the image receiving member.

DETAILED DESCRIPTION

Figure 1:
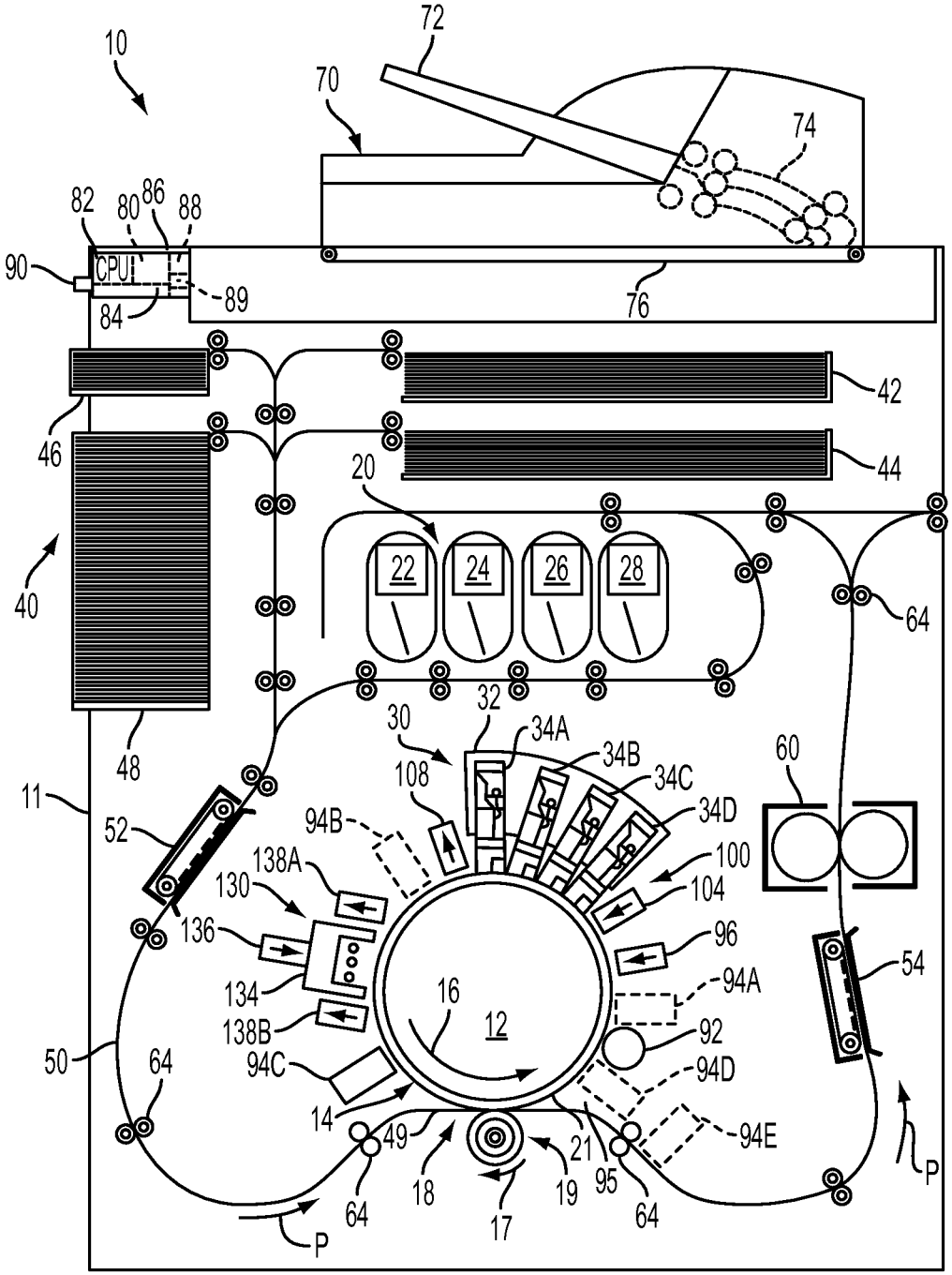
FIG. 1 is a schematic drawing of an aqueous indirect inkjet printer that prints sheet media.

For a general understanding of the present embodiments, reference is made to the drawings. In the drawings, like reference numerals have been used throughout to designate like elements. As used herein, the terms "printer," "printing device," or "imaging device" generally refer to a device that produces an image on print media with aqueous ink and may encompass any such apparatus, such as a digital copier, bookmaking machine, facsimile machine, multi-function machine, or the like, which generates printed images for any purpose. Image data generally include information in electronic form which are rendered and used to operate the inkjet ejectors to form an ink image on the print media. These data can include text, graphics, pictures, and the like. The operation of producing images with colorants on print media, for example, graphics, text, photographs, and the like, is generally referred to herein as printing or marking. Aqueous inkjet printers use inks that have a high percentage of water relative to the amount of colorant and/or solvent in the ink.

The term "printhead" as used herein refers to a component in the printer that is configured with inkjet ejectors to eject ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on an image receiving surface. Some printer embodiments include a plurality of printheads arranged in a print zone. An image receiving surface, such as an intermediate imaging surface, moves past the printheads in a process direction through the print zone. The inkjets in the printheads eject ink drops in rows in a cross-process direction, which is perpendicular to the process direction across the image receiving surface. As used in this document, the term "aqueous ink" includes liquid inks in which colorant is in a solution, suspension or dispersion with a liquid solvent that includes water and/or one or more liquid solvents. The terms "liquid solvent" or more simply "solvent" are used broadly to include compounds that may dissolve colorants into a solution, or that may be a liquid that holds particles of colorant in a suspension or dispersion without dissolving the colorant.

As used herein, the term "hydrophilic" refers to any composition or compound that attracts water molecules or other solvents used in aqueous ink. As used herein, a reference to a hydrophilic composition refers to a liquid carrier that carries a hydrophilic absorption agent. Examples of liquid carriers include, but are not limited to, a liquid, such as water or alcohol, that carries a dispersion, suspension, or solution of an absorption agent. A dryer then removes at least a portion of the liquid carrier and the remaining solid or gelatinous phase absorption agent has a high surface energy to absorb a portion of the water in aqueous ink drops while enabling the colorants in the aqueous ink drops to spread over the surface of the absorption agent. As used herein, a reference to a dried layer of the absorption agent refers to an arrangement of a hydrophilic compound after all or a substantial portion of the liquid carrier has been removed from the composition through a drying process. As described in more detail below, an indirect inkjet printer forms a layer of a hydrophilic composition on a surface of an image receiving member using a liquid carrier, such as water, to apply a layer of the hydrophilic composition. The liquid carrier is used as a mechanism to convey an absorption agent in the liquid carrier to an image receiving surface to form a uniform layer of the hydrophilic composition on the image receiving surface.

As used herein, the term "absorption agent" refers to a material that is part of the hydrophilic composition, that has hydrophilic properties, and that is substantially insoluble to water and other solvents in aqueous ink during a printing process after the printer dries the absorption agent into a dried layer or "skin" that covers the image receiving surface. The printer dries the hydrophilic composition to remove all or a portion of the liquid carrier to form a dried "skin" of the absorption agent on the image receiving surface. The dried layer of the absorption agent has a high surface energy with respect to the ink drops that are ejected onto the image receiving surface. The high surface energy promotes spreading of the ink on the surface of the dried layer, and the high surface energy holds the aqueous ink in place on the moving image receiving member during the printing process.

When aqueous ink drops contact the absorption agent in the dried layer, the absorption agent absorbs a portion of the water and other solvents in the aqueous ink drop. The absorption agent in the portion of the dried layer that absorbs the water swells, but remains substantially intact during the printing operation and does not dissolve. The absorption agent in portions of the dried layer that do not contact aqueous ink has a comparatively high adhesion to the image receiving surface and a comparatively low adhesion to a print medium, such as paper. The portions of the dried layer that absorb water and solvents from the aqueous ink have a lower adhesion to the image receiving surface, and prevent colorants and other highly adhesive components in the ink from contacting the image receiving surface. Thus, the absorption agent in the dried layer promotes the spread of the ink drops to form high quality printed images, holds the aqueous ink in position during the printing process, promotes the transfer of the latent ink image from the image receiving member to paper or another print medium, and promotes the separation of the print medium from the image receiving surface after the aqueous ink image has been transferred to the print medium.

The layer of the hydrophilic composition is formed from a material, such as starch or polyvinyl acetate, which is dispersed, suspended, or dissolved in a liquid carrier such as water. The hydrophilic composition is applied to an image receiving surface as a liquid to enable formation of a uniform layer on the image receiving surface. The printer dries the hydrophilic composition to remove at least a portion of the liquid carrier from the hydrophilic composition to form a dried layer of solid or semi-solid absorption agent.

FIG. 1 illustrates a high-speed aqueous ink image producing machine or printer 10. As illustrated, the printer 10 is an indirect printer that forms an ink image on a surface of a blanket 21 mounted about an intermediate rotating member 12 and then transfers the ink image to media passing through a nip 18 formed between the blanket 21 and the transfix roller 19. The surface 14 of the blanket 21 is referred to as the image receiving surface of the blanket 21 and the rotating member 12 since the surface 14 receives a hydrophilic composition and the aqueous ink images that are transfixed to print media during a printing process. A print cycle is now described with reference to the printer 10. As used in this document, "print cycle" refers to the operations of a printer to prepare an imaging surface for printing, ejection of the ink onto the prepared surface, treatment of the ink on the imaging surface to stabilize and prepare the image for transfer to media, and transfer of the image from the imaging surface to the media.

The printer 10 includes a frame 11 that supports directly or indirectly operating subsystems and components, which are described below. The printer 10 includes an indirect image receiving member, which is illustrated as rotating imaging drum 12 in FIG. 1, but can also be configured as a supported endless belt. The imaging drum 12 has an outer blanket 21 mounted about the circumference of the drum 12. The blanket moves in a direction 16 as the member 12 rotates. A transfix roller 19 rotatable in the direction 17 is loaded against the surface of blanket 21 to form a transfix nip 18, within which ink images formed on the surface of blanket 21 are transfixed onto a media sheet 49. In some embodiments, a heater in the drum 12 (not shown) or in another location of the printer heats the image receiving surface 14 on the blanket 21 to a temperature in a range of approximately of 35° C. to 70° C. The elevated temperature promotes partial drying of the liquid carrier that is used to deposit the hydrophilic composition and of the water in the aqueous ink drops that are deposited on the image receiving surface 14.

The blanket is formed of a material having a relatively low surface energy to facilitate transfer of the ink image from the surface of the blanket 21 to the media sheet 49 in the nip 18. Such materials include silicones, fluoro-silicones, Viton, and the like. A surface maintenance unit (SMU) 92 removes residual ink left on the surface of the blanket 21 after the ink images are transferred to the media sheet 49. The low energy surface of the blanket does not aid in the formation of good quality ink images because such surfaces do not spread ink drops as well as high energy surfaces. Consequently, the SMU 92 applies a coating of a hydrophilic composition to the image receiving surface 14 on the blanket 21. The hydrophilic composition aids in spreading aqueous ink drops on the image receiving surface, inducing solids to precipitate out of the liquid ink, and aiding in the release of the ink image from the blanket. Examples of hydrophilic compositions include surfactants, starches, and the like.

In one embodiment, the SMU 92 includes a coating applicator, such as a donor roller, which is partially submerged in a reservoir that holds a hydrophilic composition in a liquid carrier. The donor roller rotates in response to the movement of the image receiving surface 14 in the process direction. The donor roller draws the liquid hydrophilic composition from the reservoir and deposits a layer of the hydrophilic composition on the image receiving surface 14. As described below, the hydrophilic composition is deposited as a uniform layer with a thickness of approximately 1 μm to 10 μm. The SMU 92 deposits the hydrophilic composition on the image receiving surface 14 to form a uniform distribution of the absorption agent in the liquid carrier of the hydrophilic composition. After a drying process, the dried layer forms a "skin" of the absorption agent that substantially covers the image receiving surface 14 before the printer ejects ink drops during a print process. In some illustrative embodiments, the donor roller is an anilox roller or an elastomeric roller made of a material, such as rubber. The SMU 92 is operatively connected to a controller 80, described in more detail below, to enable the controller to operate the donor roller, metering blade and cleaning blade selectively to deposit and distribute the coating material onto the surface of the blanket and remove untransferred ink pixels from the surface of the blanket 21.

The printers 10 and 200 include a dryer 96 that emits heat and optionally directs an air flow toward the hydrophilic composition that is applied to the image receiving surface 14. The dryer 96 facilitates the evaporation of at least a portion of the liquid carrier from the hydrophilic composition to leave a dried layer of absorption agent on the image receiving surface 14 before the image receiving member passes the printhead modules 34A-34D to receive the aqueous printed image. As described more fully below, a controller operates the dryer to regulate the pressure and/or temperature of the dryer 96.

The printers 10 and 200 include an optical sensor 94A, also known as an image-on-drum ("IOD") sensor, which is configured to detect light reflected from the blanket surface 14 and the coating applied to the blanket surface as the member 12 rotates past the sensor. The optical sensor 94A includes a linear array of individual optical detectors that are arranged in the cross-process direction across the blanket 21. The optical sensor 94A generates digital image data corresponding to light that is reflected from the blanket surface 14 and the coating. The optical sensor 94A generates a series of rows of image data, which are referred to as "scanlines," as the image receiving member 12 rotates the blanket 21 in the direction 16 past the optical sensor 94A. In one embodiment, each optical detector in the optical sensor 94A further comprises three sensing elements that are sensitive to wavelengths of light corresponding to red, green, and blue (RGB) reflected light colors. Alternatively, the optical sensor 94A includes illumination sources that shine red, green, and blue light or, in another embodiment, the sensor 94A has an illumination source that shines white light onto the surface of blanket 21 and white light detectors are used. The optical sensor 94A shines complementary colors of light onto the image receiving surface to enable detection of different ink colors using the photodetectors. The image data generated by the optical sensor 94A is analyzed by the controller 80 or other processor in the printers 10 and 200 to identify the thickness of the coating on the blanket and the area coverage. The thickness and coverage can be identified from either specular or diffuse light reflection from the blanket surface and/or coating. Other optical sensors, such as 94B, 94C, and 94D, are similarly configured and can be located in different locations around the blanket 21 to identify and evaluate other parameters in the printing process, such as missing or inoperative inkjets and ink image formation prior to image drying (94B), ink image treatment for image transfer (94C), and the efficiency of the ink image transfer (94D). Alternatively, some embodiments can include an optical sensor to generate additional data that can be used for evaluation of the image quality on the media (94E).

The printer 10 includes an airflow management system 100, which generates and controls a flow of air through the print zone. The airflow management system 100 includes a printhead air supply 104 and a printhead air return 108. The printhead air supply 104 and return 108 are operatively connected to the controller 80 or some other processor in the printer 10 to enable the controller to manage the air flowing through the print zone. This regulation of the air flow can be through the print zone as a whole or about one or more printhead arrays. The regulation of the air flow helps prevent evaporated solvents and water in the ink from condensing on the printhead and helps attenuate heat in the print zone to reduce the likelihood that ink dries in the inkjets, which can clog the inkjets. The airflow management system 100 can also include sensors to detect humidity and temperature in the print zone to enable more precise control of the temperature, flow, and humidity of the air supply 104 and return 108 to ensure optimum conditions within the print zone. Controller 80 or some other processor in the printer 10 can also enable control of the system 100 with reference to ink coverage in an image area or even to time the operation of the system 100 so air only flows through the print zone when an image is not being printed.

The high-speed aqueous ink printer 10 also includes an aqueous ink supply and delivery subsystem 20 that has at least one source 22 of one color of aqueous ink. Since the illustrated printer 10 is a multicolor image producing machine, the ink delivery system 20 includes four (4) sources 22, 24, 26, 28, representing four (4) different colors CYMK (cyan, yellow, magenta, black) of aqueous inks. In the embodiment of FIG. 1, the printhead system 30 includes a printhead support 32, which provides support for a plurality of printhead modules, also known as print box units, 34A through 34D. Each printhead module 34A-34D effectively extends across the width of the blanket and ejects ink drops onto the surface 14 of the blanket 21. A printhead module can include a single printhead or a plurality of printheads configured in a staggered arrangement. Each printhead module is operatively connected to a frame (not shown) and aligned to eject the ink drops to form an ink image on the coating on the blanket surface 14. The printhead modules 34A-34D can include associated electronics, ink reservoirs, and ink conduits to supply ink to the one or more printheads. In the illustrated embodiment, conduits (not shown) operatively connect the sources 22, 24, 26, and 28 to the printhead modules 34A-34D to provide a supply of ink to the one or more printheads in the modules. As is generally familiar, each of the one or more printheads in a printhead module can eject a single color of ink. In other embodiments, the printheads can be configured to eject two or more colors of ink. For example, printheads in modules 34A and 34B can eject cyan and magenta ink, while printheads in modules 34C and 34D can eject yellow and black ink. The printheads in the illustrated modules are arranged in two arrays that are offset, or staggered, with respect to one another to increase the resolution of each color separation printed by a module. Such an arrangement enables printing at twice the resolution of a printing system only having a single array of printheads that eject only one color of ink. Although the printer 10 includes four printhead modules 34A-34D, each of which has two arrays of printheads, alternative configurations include a different number of printhead modules or arrays within a module.

After the printed image on the blanket surface 14 exits the print zone, the image passes under an image dryer 130. The image dryer 130 includes a heater, such as a radiant infrared, radiant near infrared and/or a forced hot air convection heater 134, a dryer 136, which is illustrated as a heated air source 136, and air returns 138A and 138B. The infrared heater 134 applies infrared heat to the printed image on the surface 14 of the blanket 21 to evaporate water or solvent in the ink. The heated air source 136 directs heated air over the ink to supplement the evaporation of the water or solvent from the ink. In one embodiment, the dryer 136 is a heated air source with the same design as the dryer 96. While the dryer 96 is positioned along the process direction to dry the hydrophilic composition, the dryer 136 is positioned along the process direction after the printhead modules 34A-34D to partially dry the aqueous ink on the image receiving surface 14. The air is then collected and evacuated by air returns 138A and 138B to reduce the interference of the air flow with other components in the printing area.

As further shown, the printer 10 includes a recording media supply and handling system 40 that stores, for example, one or more stacks of paper media sheets of various sizes. The recording media supply and handling system 40, for example, includes sheet or substrate supply sources 42, 44, 46, and 48. In the embodiment of printer 10, the supply source 48 is a high capacity paper supply or feeder for storing and supplying image receiving substrates in the form of cut media sheets 49, for example. The recording media supply and handling system 40 also includes a substrate handling and transport system 50 that has a media pre-conditioner assembly 52 and a media post-conditioner assembly 54. The printer 10 includes an optional fusing device 60 to apply additional heat and pressure to the print medium after the print medium passes through the transfix nip 18. In the embodiment of FIG. 1, the printer 10 includes an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 is operably connected to the image receiving member 12, the printhead modules 34A-34D (and thus the printheads), the substrate supply and handling system 40, the substrate handling and transport system 50, and, in some embodiments, the one or more optical sensors 94A-94E. The ESS or controller 80, for example, is a self-contained, dedicated mini-computer having a central processor unit (CPU) 82 with electronic storage 84, and a display or user interface (UI) 86. The ESS or controller 80, for example, includes a sensor input and control circuit 88 as well as a pixel placement and control circuit 89. In addition, the CPU 82 reads, captures, prepares and manages the image data flow between image input sources, such as the scanning system 76, or an online or a work station connection 90, and the printhead modules 34A-34D. As such, the ESS or controller 80 is the main multi-tasking processor for operating and controlling all of the other machine subsystems and functions, including the printing process discussed below.

The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image data for an image to be produced are sent to the controller 80 from either the scanning system 76 or via the online or work station connection 90 for processing and generation of the printhead control signals output to the printhead modules 34A-34D. Additionally, the controller 80 determines and/or accepts related subsystem and component controls, for example, from operator inputs via the user interface 86, and accordingly executes such controls. As a result, aqueous ink for appropriate colors are delivered to the printhead modules 34A-34D. Additionally, pixel placement control is exercised relative to the blanket surface 14 to form ink images corresponding to the image data, and the media, which can be in the form of media sheets 49, are supplied by any one of the sources 42, 44, 46, 48 and handled by recording media transport system 50 for timed delivery to the nip 18. In the nip 18, the ink image is transferred from the blanket and coating 21 to the media substrate within the transfix nip 18.

Figure 2:
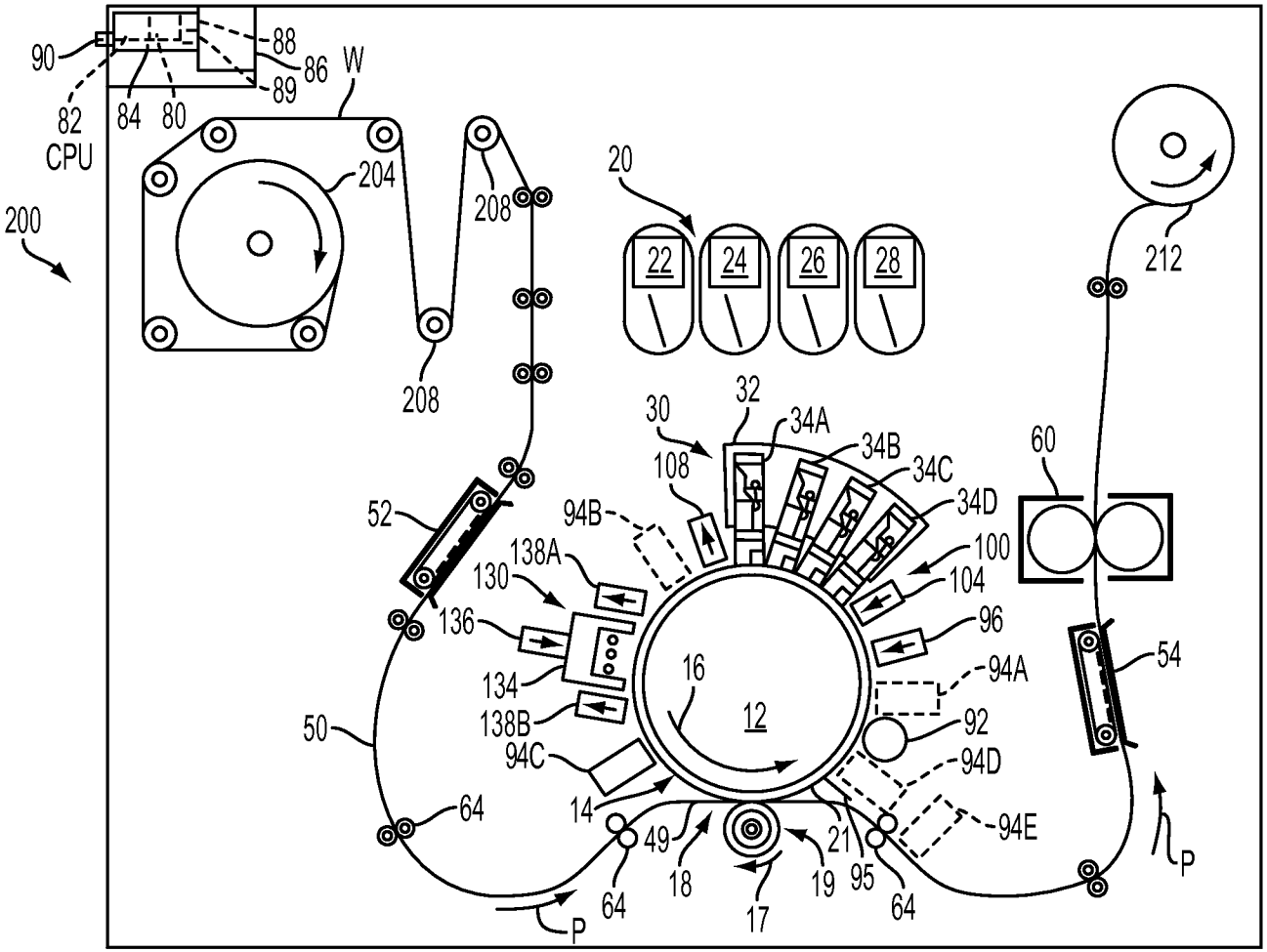
FIG. 2 is a schematic drawing of an aqueous indirect inkjet printer that prints a continuous web.

Although the printer 10 in FIG. 1 and the printer 200 in FIG. 2 are described as having a blanket 21 mounted about an intermediate rotating member 12, other configurations of an image receiving surface can be used. For example, the intermediate rotating member can have a surface integrated into its circumference that enables an aqueous ink image to be formed on the surface. Alternatively, a blanket is configured as an endless belt and rotates as the member 12 is in FIG. 1 and FIG. 2 for formation of an aqueous image. Other variations of these structures can be configured for this purpose. As used in this document, the term "intermediate imaging surface" or "imaging surface" includes these various configurations.

In some printing operations, a single ink image can cover the entire surface 14 of the blanket 21 (single pitch) or a plurality of ink images can be deposited on the blanket 21 (multi-pitch). In a multi-pitch printing architecture, the surface of the image receiving member can be partitioned into multiple segments, each segment including a full page image in a document zone (i.e., a single pitch) and inter-document zones that separate multiple pitches formed on the blanket 21. For example, a two pitch image receiving member includes two document zones that are separated by two inter-document zones around the circumference of the blanket 21. Likewise, for example, a four pitch image receiving member includes four document zones, each corresponding to an ink image formed on a single media sheet, during a pass or revolution of the blanket 21.

Once an image or images have been formed on the blanket and coating under control of the controller 80, the illustrated inkjet printer 10 operates components within the printer to perform a process for transferring and fixing the image or images from the blanket surface 14 to media. The transfer process can be performed after a document zone has made a single pass through the print zone to form the ink image in the document zone or the transfer process can be performed after the one or more document zones have rotated through the print zone more than once for the formation of the image in the one or more document zones. In the printer 10, the controller 80 operates actuators to drive one or more of the rollers 64 in the media transport system 50 to move the media sheet 49 in the process direction P to a position adjacent the transfix roller 19 and then through the transfix nip 18 between the transfix roller 19 and the blanket 21. The transfix roller 19 applies pressure against the back side of the recording media 49 in order to press the front side of the recording media 49 against the blanket 21 and the image receiving member 12. Although the transfix roller 19 can also be heated, in the exemplary embodiment of FIG. 1, the transfix roller 19 is unheated. Instead, the pre-heater assembly 52 for the media sheet 49 is provided in the media path leading to the nip. The pre-conditioner assembly 52 conditions the media sheet 49 to a predetermined temperature that aids in the transferring of the image to the media, thus simplifying the design of the transfix roller. The pressure produced by the transfix roller 19 on the back side of the heated media sheet 49 facilitates the transfixing (transfer and fusing) of the image from the image receiving member 12 onto the media sheet 49. The rotation or rolling of both the image receiving member 12 and transfix roller 19 not only transfixes the images onto the media sheet 49, but also assists in transporting the media sheet 49 through the nip. The image receiving member 12 continues to rotate to enable the printing process to be repeated.

After the image receiving member moves through the transfix nip 18, the image receiving surface passes a cleaning unit that removes residual portions of the absorption agent and small amounts of residual ink from the image receiving surface 14. In the printers 10 and 200, the cleaning unit is embodied as a cleaning blade 95 that engages the image receiving surface 14. The blade 95 is formed from a material that wipes the image receiving surface 14 without causing damage to the blanket 21. For example, the cleaning blade 95 is formed from a flexible polymer material in the printers 10 and 200. As depicted below in FIG. 3, another embodiment has a cleaning unit that includes a roller or other member that applies a mixture of water and detergent to remove residual materials from the image receiving surface 14 after the image receiving member moves through the transfix nip 18. As used herein, the term "detergent" or cleaning agent refers to any surfactant, solvent, or other chemical compound that is suitable for removing the dried portion of the absorption agent and any residual ink that may remain on the image receiving surface from the image receiving surface. One example of a suitable detergent is sodium stearate, which is a compound commonly used in soap. Another example is IPA, which is common solvent that is very effective to remove ink residues from the image receiving surface.

In the embodiment shown in FIG. 2, like components are identified with like reference numbers used in the description of the printer in FIG. 1. One difference between the printers of FIG. 1 and FIG. 2 is the type of media used. In the embodiment of FIG. 2, a media web W is unwound from a roll of media 204 as needed and a variety of motors, not shown, rotate one or more rollers 208 to propel the media web W through the nip 18 so the media web W can be wound onto a roller 212 for removal from the printer. Alternatively, the media can be directed to other processing stations that perform tasks such as cutting, binding, collating, and/or stapling the media or the like. One other difference between the printers 10 and 200 is the nip 18. In the printer 200, the transfer roller continually remains pressed against the blanket 21 as the media web W is continuously present in the nip. In the printer 10, the transfer roller is configured for selective movement towards and away from the blanket 21 to enable selective formation of the nip 18. Nip 18 is formed in the embodiment of FIG. 1 in synchronization with the arrival of media at the nip to receive an ink image and is separated from the blanket to remove the nip as the trailing edge of the media leaves the nip.

Figure 3:
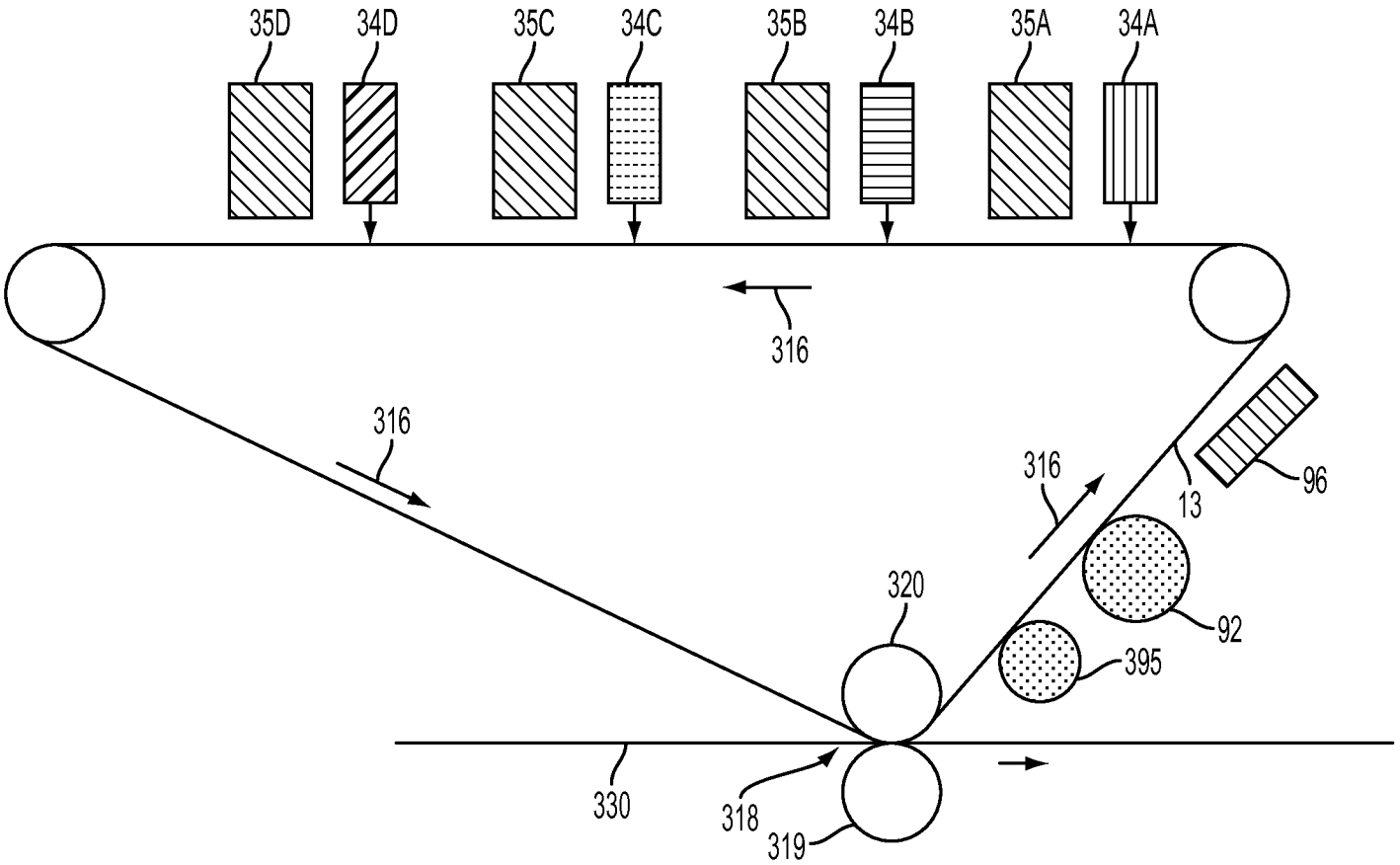
FIG. 3 is a schematic diagram of an inkjet printer that includes an endless belt indirect image receiving member.

FIG. 3 is a simplified schematic diagram of another inkjet printer 300 where the indirect image receive member is in the form of an endless belt 13. The belt 13 moves in a process direction as indicated by the arrows 316 to pass an SMU 92, dryer 96, printhead modules 34A-34D, and ink dryers 35A-35D to receive a dried layer of absorption agent and a latent aqueous ink image that is formed on the dried layer. The belt 13 is formed from a low surface energy material, such as silicone, fluorosilicone, hydrofluoroelastomers, and hybrids and blends of silicone and hydrofluoroelastomers, and the like. In the printer 300, the belt 13 passes between pressure rollers 319 and 319 that form a transfix nip 38. A print medium, such as the media sheet 330, moves through the nip 318 concurrently with the latent ink image. The latent ink image and a portion of the absorption agent in the dried layer transfer from the belt 13 to the print medium 330 in the transfix nip 318 to form a printed image. A cleaning unit 395 removes residual portions of the absorption agent in the dried layer from the belt 13 after completion of the transfix operation. While not expressly depicted for simplicity, the printer 300 includes additional components that are similar to the printers 10 and 200 including, but not limited to, a controller, optical sensors, media supplies, a media path, ink reservoirs, and other components that are associated with the handling of ink and print media in an inkjet printer.

Figure 4:
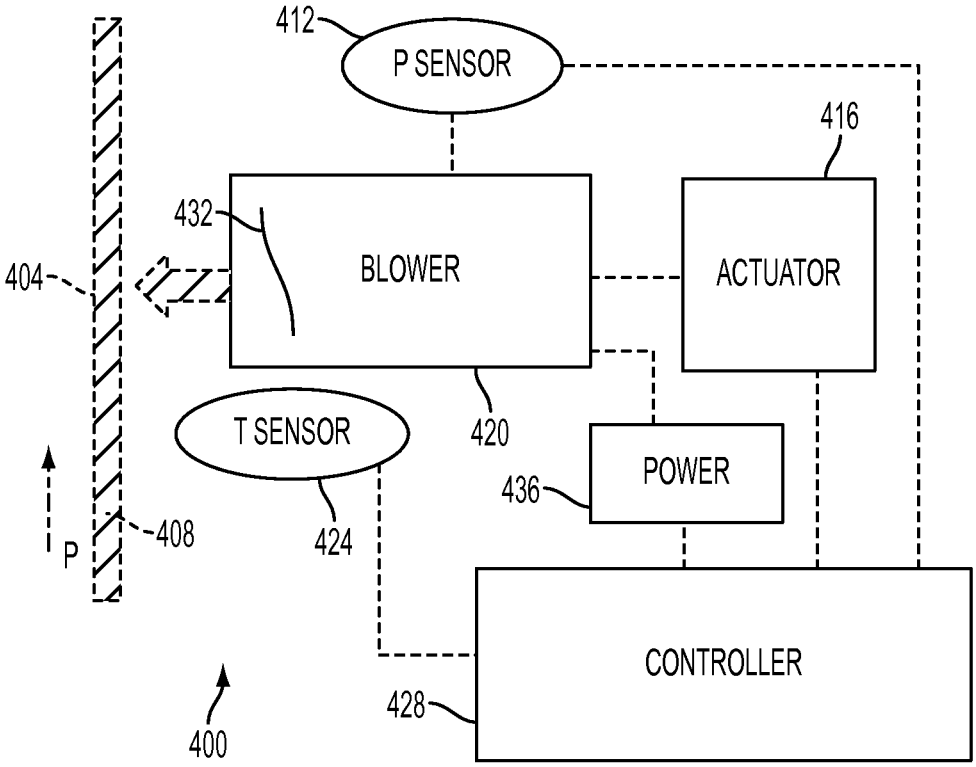
FIG. 4 is a schematic drawing of a blower and a blower controller that dries a hydrophilic composition layer on a surface of an indirect image receiving member in an inkjet printer.

A schematic diagram of a hydrophilic composition treatment system 400 is shown in FIG. 4. The system 400 includes a blower 420, a pressure sensor 412, an actuator 416, a temperature sensor 424, and a controller 428. The blower 420 is configured to direct a flow of air toward a hydrophilic composition layer 408 as an image receiving surface in the inkjet printer, such as endless belt 404, moves past the blower in a process direction P to remove at least a portion of liquid carrier in the hydrophilic composition. The controller 428 is operatively connected to the blower and the controller is configured, as described above, with programmed instructions and/or electronic circuitry to operate the blower 420 and regulate a pressure of the air flow generated by the blower. The blower 420 includes a heater element 432 that is configured for selective connection to an electrical power source 436. The controller is configured to connect the heater element selectively to the electrical power source 436 to regulate a temperature of the air flow directed toward the hydrophilic composition layer 408.

The controller 428 is also operatively connected to at least one of the optical sensors 94B, 94C, and 94E. In some embodiments, the controller 428 is operatively to all three of the optical sensors. The optical sensors provide image data of ink drops on the intermediate image receiving surface. These image data are analyzed by the controller 428, which compares, for example, drop spread to empirically determined drop spreads on hydrophilic layers having a dryness level in a predetermined range. This predetermined range corresponds to image quality that is acceptable for the images produced by the printer. Thus, the controller 428 operates the blower 420 and the heater element 432 with reference to the image data and the empirically determined drop spreads to maintain the hydrophilic layer at an appropriate level of dryness.

To help regulate the temperature of the air flow produced by the blower 420, a temperature sensor 424 is positioned in some embodiments to sense a temperature of the air flow directed toward the hydrophilic composition layer 408. The temperature sensor generates an electrical signal indicative of the temperature sensed in the air flow and is operatively connected to the controller 428 so the controller receives the electrical signal generated by the temperature sensor 424. If the controller 428 has determined that the drop spread indicated by the image data requires the hydrophilic layer to be drier, then controller 428 can increase the temperature of the air flow directed toward the hydrophilic composition layer 404. This increased temperature can be monitored with the data from the temperature sensor and compared to a maximum temperature value to ensure the air is not over heated. As the drop spread changes, the controller 428 can further adjust and monitor the application of current to the heating element to reduce the likelihood that the dryness level is adjusted too quickly.

The controller is also operatively connected to the actuator 416, which is operatively connected to the blower to move the blower toward and away from the image receiving member 404. The controller 428 is configured to operate the actuator 416 to move the blower to regulate the pressure of the air flow produced by the blower 420. To provide feedback regarding the pressure of the air flow, a pressure sensor 412 is positioned to sense the pressure of the air flow directed toward the hydrophilic composition layer 408 and is configured to generate an electrical signal indicative of the pressure of the sensed air flow. If the controller 428 has determined that the drop spread indicated by the image data requires the hydrophilic layer to be drier, then controller 428 can increase the amount of the air flow directed toward the hydrophilic composition layer 404. This increased air flow can be monitored with the data from the pressure sensor and compared to a maximum pressure level to ensure the generated pressure is not too great. As the drop spread changes, the controller 428 can further adjust and monitor the position of the blower to reduce the likelihood that the dryness level is adjusted too quickly. Alternatively or additionally, the controller can adjust a speed of blower that produces the air flow.

As discussed above, the printer can include an optical sensor 94B, 94C, and 94E, all of which are configured to generate image data of ink drops on the imaging surface. These data can be provided to controller 428 or another controller in the printer, which analyzes the image data to detect ink drop spread on the image receiving member and generate an electrical signal corresponding to the detected drop spread. This electrical signal is operatively connected to the controller 428 so the controller regulates pressure of the air flow directed at the hydrophilic composition layer 408 with reference to the electrical signal generated by the optical sensor 94A. Specifically, the controller 428 can terminate operation of the blower after a trailing edge of an ink image on the image receiving member has passed the blower. This type of operation enables the blower to treat only the hydrophilic layer 404 that underlies the ink image and prevents continual drying of the layer where no ink drops are affected. During multi-pass ink formation operation, the detection of the leading and trailing edge of the ink image enables the controller to reduce the pressure of the air flow generated by the blower during each pass of the ink image past the blower.

Figure 5:
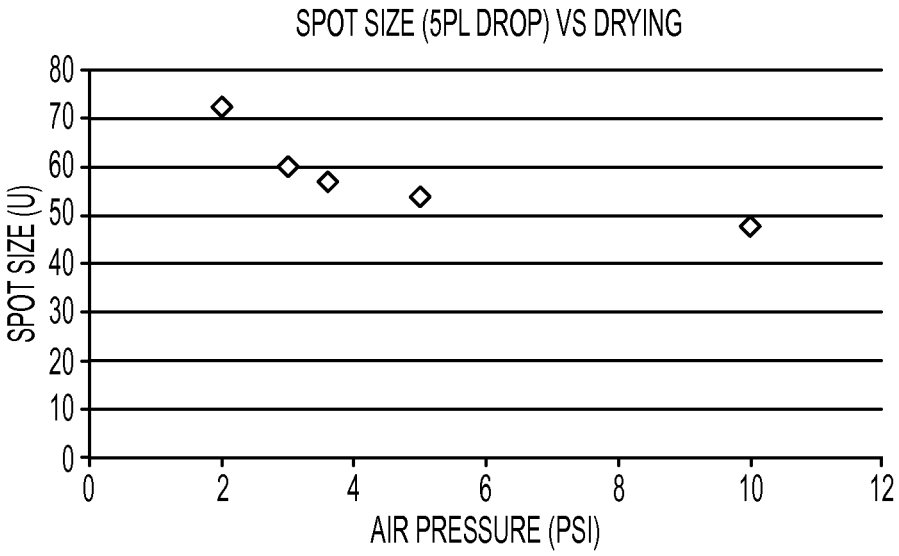
FIG. 5 is a graph showing the effect of air pressure on the spot size of a five picoliter aqueous ink drop on a hydrophilic composition layer.

While the system 400 is shown with a pressure sensor 412, a temperature sensor 424, an actuator 416 and a power source for the blower operatively connected to the controller 428, different combinations and permutations of the sensors, actuator, and power source, including only one of them, can be operatively connected to the controller to enable regulation of the blower operation. Thus, the controller can be configured differently for the various combinations and permutations so the controller regulates pressure only, temperature only, the gap between the blower and the layer 408 only, or combinations of these parameters. In operation, an indirect printer is configured with one of the embodiments of the hydrophilic composition system 400 to enable more efficient and effective control of the drying of the hydrophilic composition layer in the printer. This more effective drying enables neighboring aqueous ink drops to merge together on the image receiving surface instead of beading into individual droplets as occurs in traditional low-surface energy image receiving surfaces. The relationship between ink drop spread (drop size) and the pressure of the air flow from the blower 420 is shown in the graph of FIG. 5.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An inkjet printer comprising:

an indirect image receiving member having an image receiving surface configured to move in a process direction in the inkjet printer;

a surface maintenance unit configured to apply a layer of a hydrophilic composition comprising a liquid carrier and an absorption agent to the image receiving surface;

a blower configured to direct a flow of air toward the layer of hydrophilic composition on the image receiving surface to remove at least a portion of the liquid carrier from the layer of hydrophilic composition, forming a dried layer;

a plurality of inkjets configured to eject aqueous ink onto the dried layer to form an aqueous ink image on the image receiving surface;

a transfix member that engages the image receiving member to form a transfix nip, the transfix member being configured to apply pressure to a print medium moving through the transfix nip as the aqueous ink image on the dried layer moves through the transfix nip to transfix the aqueous ink image and the region of the dried layer that receives the aqueous ink to a surface of the print medium;

an optical sensor configured to generate image data of ink drops on the image receiving member; and a controller operatively connected to the blower and the optical sensor, the controller being configured to operate the blower with reference to the image data of the ink drops on the image receiving member.

2. The printer of claim 1, the blower further comprising:

a heater element configured for selective connection to an electrical power source; and the controller being further configured to selectively connect the heater element to the electrical power source with reference to the image data of the ink drops on the image receiving member to regulate a temperature of the air flow directed toward the hydrophilic composition.

3. The printer of claim 2 further comprising:

a temperature sensor positioned to sense a temperature of the air flow directed toward the hydrophilic composition, the temperature sensor being configured to generate an electrical signal indicative of the temperature sensed in the air flow; and the controller being operatively connected to the temperature sensor to receive the electrical signal generated by the temperature sensor, and the controller being further configured to regulate the temperature of the air flow directed toward the hydrophilic composition with reference to a maximum temperature value and the electrical signal received from the temperature sensor.

4. The printer of claim 1 further comprising:

an actuator operatively connected to the blower, the actuator being configured to move the blower toward and away from the image receiving member; and the controller being further configured to operate the actuator to move the blower with reference to the image data of the ink drops on the image receiving member.

5. The printer of claim 4 further comprising:

a pressure sensor positioned to sense the pressure of the air flow directed toward the hydrophilic composition, the pressure sensor being configured to generate an electrical signal indicative of the pressure of the sensed air flow; and the controller being operatively connected to the pressure sensor to receive the electrical signal generated by the pressure sensor, and the controller being further configured to regulate the pressure of the air flow directed toward the hydrophilic composition with reference to a maximum pressure value and the electrical signal received from the pressure sensor.

6. The printer of claim 5, the controller being further configured to operate the actuator to move the blower or to adjust a speed of the blower with reference to the image data of the ink drops on the image receiving member to regulate the pressure of the air flow directed toward the hydrophilic composition.

7. The printer of claim 1 further comprising:

a pressure sensor positioned to sense a pressure of the air flow directed toward the hydrophilic composition, the pressure sensor being configured to generate an electrical signal indicative of the pressure sensed in the air flow; and the controller being operatively connected to the pressure sensor to receive the electrical signal generated by the pressure sensor, and the controller being further configured to regulate the pressure of the air flow directed toward the hydrophilic composition with reference to a maximum pressure level and the electrical signal received from the pressure sensor.

8. The printer of claim 1, the controller being further configured to terminate operation of the blower with reference to image data of the ink drops on the image receiving member indicating a trailing edge of an ink image on the image receiving member has passed the optical sensor.

9. The printer of claim 8, the controller being configured to reduce the pressure of the air flow generated by the blower during each pass of the ink image past the optical sensor.

10. A hydrophilic composition treatment system for an inkjet printer comprising:

a blower configured to direct a flow of air toward a hydrophilic composition on an image receiving surface in the inkjet printer to remove at least a portion of liquid carrier in the hydrophilic composition;

an optical sensor configured to generate image data of ink drops on the image receiving member; and a controller operatively connected to the blower and the optical sensor, the controller being configured to operate the blower with reference to the image data of the ink drops on the image receiving member.

11. The hydrophilic composition treatment system of claim 10, the blower further comprising:

a heater element configured for selective connection to an electrical power source; and the controller being further configured to selectively connect the heater element to the electrical power source to regulate a temperature of the air flow directed toward the hydrophilic composition.

12. The hydrophilic composition treatment system of claim 11, the controller being further configured to regulate the temperature of the air flow with reference to a maximum temperature value.

13. The hydrophilic composition treatment system of claim 11 further comprising:

a temperature sensor positioned to sense a temperature of the air flow directed toward the hydrophilic composition, the temperature sensor being configured to generate an electrical signal indicative of the temperature sensed in the air flow; and the controller being operatively connected to the temperature sensor to receive the electrical signal generated by the temperature sensor, and the controller being further configured to regulate the temperature of the air flow directed toward the hydrophilic composition with reference to the maximum temperature value and the electrical signal received from the temperature sensor.

14. The hydrophilic composition treatment system of claim 10 further comprising:

an actuator operatively connected to the blower, the actuator being configured to move the blower toward and away from the image receiving member; and the controller being further configured to operate the actuator to move the blower with reference to the image data of the ink drops on the image receiving member to regulate the pressure of the air flow.

15. The hydrophilic composition treatment system of claim 14 further comprising:

a pressure sensor positioned to sense the pressure of the air flow directed toward the hydrophilic composition, the pressure sensor being configured to generate an electrical signal indicative of the pressure of the sensed air flow; and the controller being operatively connected to the pressure sensor to receive the electrical signal generated by the pressure sensor, and the controller being further configured to regulate the pressure of the air flow directed toward the hydrophilic composition with reference to a maximum pressure value and the electrical signal received from the pressure sensor.

16. The hydrophilic composition treatment system of claim 15, the controller being further configured to operate the actuator to move the blower or to adjust a speed of the blower with reference to the image data of the ink drops on the image receiving member to regulate the pressure of the air flow directed toward the hydrophilic composition.

17. The hydrophilic composition treatment system of claim 13 further comprising:

a pressure sensor positioned to sense a pressure of the air flow directed toward the hydrophilic composition, the pressure sensor being configured to generate an electrical signal indicative of the pressure sensed in the air flow; and the controller being operatively connected to the pressure sensor to receive the electrical signal generated by the pressure sensor, and the controller being further configured to regulate the pressure of the air flow directed toward the hydrophilic composition with reference to a maximum pressure value and the electrical signal received from the pressure sensor.

18. The hydrophilic composition treatment system of claim 10, the controller being configured to terminate operation of the blower with reference to image data of the ink drops on the image receiving member indicating a trailing edge of an ink image on the image receiving member has passed the optical sensor.

19. The hydrophilic composition treatment system of claim 18, the controller being configured to reduce the pressure of the air flow generated by the blower during each pass of the ink image past the optical sensor.

* * * * *